US011718104B2

(12) United States Patent
Yuasa

(10) Patent No.: US 11,718,104 B2
(45) Date of Patent: Aug. 8, 2023

(54) PRINTED MATTER CREATING DEVICE PERFORMING ADJUSTMENT OF ON DOTS IN CONNECTING PART OF FIRST PRINT AND SECOND PRINT

(71) Applicant: BROTHER KOGYO KABUSHIKI KAISHA, Nagoya (JP)

(72) Inventor: Eri Yuasa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/705,102

(22) Filed: Mar. 25, 2022

(65) Prior Publication Data

US 2022/0305807 A1 Sep. 29, 2022

(30) Foreign Application Priority Data

Mar. 26, 2021 (JP) ..... 2021-054037

(51) Int. Cl.

| | |
|---|---|
| ***B41J 2/50*** | (2006.01) |
| ***B41J 2/505*** | (2006.01) |
| ***B41J 2/21*** | (2006.01) |
| ***B41J 11/66*** | (2006.01) |
| ***B41J 11/70*** | (2006.01) |

(52) U.S. Cl.

CPC ..... *B41J 2/5056* (2013.01); *B41J 2/2121* (2013.01); *B41J 11/663* (2013.01); *B41J 11/70* (2013.01)

(58) Field of Classification Search

CPC ..... B41J 2/04505; B41J 2/04586; B41J 2202/20; B41J 2202/21; B41J 2/5056; B41J 2/2146; B41J 2/2121; B41J 2/2135; B41J 11/663; B41J 11/42; B41J 11/70; B41J 11/703; B41J 3/4075; G06K 15/102; G06K 15/105; G06K 15/107

See application file for complete search history.

(56) References Cited

U.S. PATENT DOCUMENTS

| | | | | |
|---|---|---|---|---|
| 2017/0182805 | A1* | 6/2017 | Kawai | B41J 13/0009 |
| 2018/0088874 | A1* | 3/2018 | Minami | B41J 2/365 |
| 2018/0250959 | A1* | 9/2018 | Sato | B41J 11/007 |
| 2018/0264859 | A1* | 9/2018 | Kawamata | B41J 11/666 |
| 2019/0016161 | A1 | 1/2019 | Kawai | |

FOREIGN PATENT DOCUMENTS

| | | | |
|---|---|---|---|
| JP | H07-266622 | A | 10/1995 |
| JP | 2019-018390 | A | 2/2019 |

* cited by examiner

*Primary Examiner* — Kristal Feggins
(74) *Attorney, Agent, or Firm* — Kenealy Vaidya LLP

(57) ABSTRACT

A printed matter creating device includes a controller configured to: acquire print data; form a first print on a printing medium while conveying the printing medium, the first print being based on first ON dots in the acquired print data; interrupt the conveyance of the printing medium after forming the first print; cut the printing medium after interrupting the conveyance; and form a second print on the printing medium while conveying the printing medium after cutting the printing medium, the second print being based on second ON dots in the acquired print data. The print data includes a specific print data corresponding to a connecting part connecting the first print and the second print. Based on the acquired print data, the controller adjusts at least one of: aspects of the first ON dots in the specific print data; and aspects of the second ON dots in the specific print data.

14 Claims, 7 Drawing Sheets

PRINTED MATTER CREATING DEVICE PERFORMING ADJUSTMENT OF ON DOTS IN CONNECTING PART OF FIRST PRINT AND SECOND PRINT

CROSS REFERENCE TO RELATED APPLICATIONS

This application claims priority from Japanese Patent Application No. 2021-054037 filed Mar. 26, 2021. The entire content of the priority application is incorporated herein by reference.

BACKGROUND

To interrupt printing, a conventional printed matter creating device halts the drive of the printing means and halts feeding of the printing medium to the next line. When resuming printing, the conventional device first redundantly prints the line that was printed by the printing means just prior to the interruption of printing while feeding of the printing medium to the next line remains halted and subsequently resumes printing from the next line.

This technique reduces the potential for a print omission caused by the printing medium being shifted slightly along the conveying direction during the cutting process while the printing of print data was interrupted.

SUMMARY

However, if the print data represents an image or a pattern rather than characters, the redundantly printed area printed by the conventional printed matter creating device may be noticeably darker.

In view of the foregoing, it is an object of the present disclosure to provide a printed matter creating device which can satisfactorily print without a redundantly printed area becoming noticeably darker by correcting the level of darkness of the redundantly printed area based on the print data.

In order to attain the above and other objects, according to one aspect, the present disclosure provides a printed matter creating device including: a conveyor, a printing head, a cutter, and a controller. The conveyor is configured to convey a printing medium along a conveying path. The printing head is configured to form a print on the printing medium being conveyed in a forward direction along the conveying path by the conveyor. The cutter is configured to cut the printing medium. The cutter is disposed on the conveying path. The cutter is positioned downstream of the printing head in the forward direction. The cutter is separated from the printing head a prescribed distance along the conveying path. The controller is configured to perform: an acquisition process to acquire print data; after completing the acquisition process, a first printing process to control the printing head to form a first print on the printing medium while controlling the conveyor to convey the printing medium, the first print being based on first ON dots included in the acquired print data; after completing the formation of the first print in the first printing process, an interrupting process to interrupt the conveyance of the printing medium by the conveyor; after performing the interrupting process, a cutting process to control the cutter to cut the printing medium; and after completing the cutting process, a second printing process to control the printing head to form a second print on the printing medium while controlling the conveyor to convey the printing medium, the second print being based on second ON dots included in the acquired print data. The acquired print data includes a specific print data corresponding to a connecting part connecting the first print and the second print. The controller further performs: an ON dot adjustment process to perform adjusting, on the basis of the acquired print data: aspects of specific first ON dots, the specific first ON dots being the first ON dots that are in the specific print data; or aspects of specific second ON dots, the specific second ON dots being the second ON dots that are in the specific print data; or both the aspects of the specific first ON dots and the aspects of the specific second ON dots.

According to another aspect, the present disclosure provides a non-transitory computer-readable storage medium storing a set of computer-readable instructions for a printed matter creating device. The printed matter creating device includes a controller, a conveyor, a printing head, a cutter, and a controller. The conveyor is configured to convey a printing medium along a conveying path. The printing head is configured to form a print on the printing medium being conveyed in a forward direction along the conveying path by the conveyor. The cutter is configured to cut the printing medium. The cutter is disposed on the conveying path. The cutter is positioned downstream of the printing head in the forward direction. The cutter is separated from the printing head a prescribed distance along the conveying path. The set of computer-readable instructions, when executed by the controller, causes the printed matter creating device to perform: an acquisition process to acquire print data; after completing the acquisition process, a first printing process to control the printing head to form a first print on the printing medium while controlling the conveyor to convey the printing medium, the first print being based on first ON dots included in the acquired print data; after completing the formation of the first print in the first printing process, an interrupting process to interrupt the conveyance of the printing medium by the conveyor; after performing the interrupting process, a cutting process to control the cutter to cut the printing medium; and after completing the cutting process, a second printing process to control the printing head to form a second print on the printing medium while controlling the conveyor to convey the printing medium, the second print being based on second ON dots included in the acquired print data. The acquired print data includes a specific print data corresponding to a connecting part connecting the first print and the second print. The set of computer-readable instructions, when executed by the controller, causes the printed matter creating device to further perform: an ON dot adjustment process to perform adjusting, on the basis of the acquired print data: aspects of specific first ON dots, the specific first ON dots being the first ON dots that are in the specific print data; or aspects of specific second ON dots, the specific second ON dots being the second ON dots that are in the specific print data; or both the aspects of the specific first ON dots and the aspects of the specific second ON dots.

Through the ON dot adjustment process in the above configurations, the appearance of a white line in the connecting part can be suppressed while a deterioration in appearance owing to the print in the connecting part being more noticeable than prints in other areas is suppressed.

Accordingly, the gradation level in the overlapped print area is corrected based on the print data to achieve satisfactory printing without the overlapped print area becoming noticeably darker.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Next, a printed matter creating device according to an embodiment of the present disclosure will be described while referring to the accompanying drawings. The external appearance and the like of the printed matter creating device in the following description may be similar to any of various well-known devices, such as the device described in Japanese unexamined patent application publication No. 2019-18390. Accordingly, a description of these aspects has been omitted in this specification, and the general structures of internal units of a print label creating device will be described as the printed matter creating device.

Figure 1:
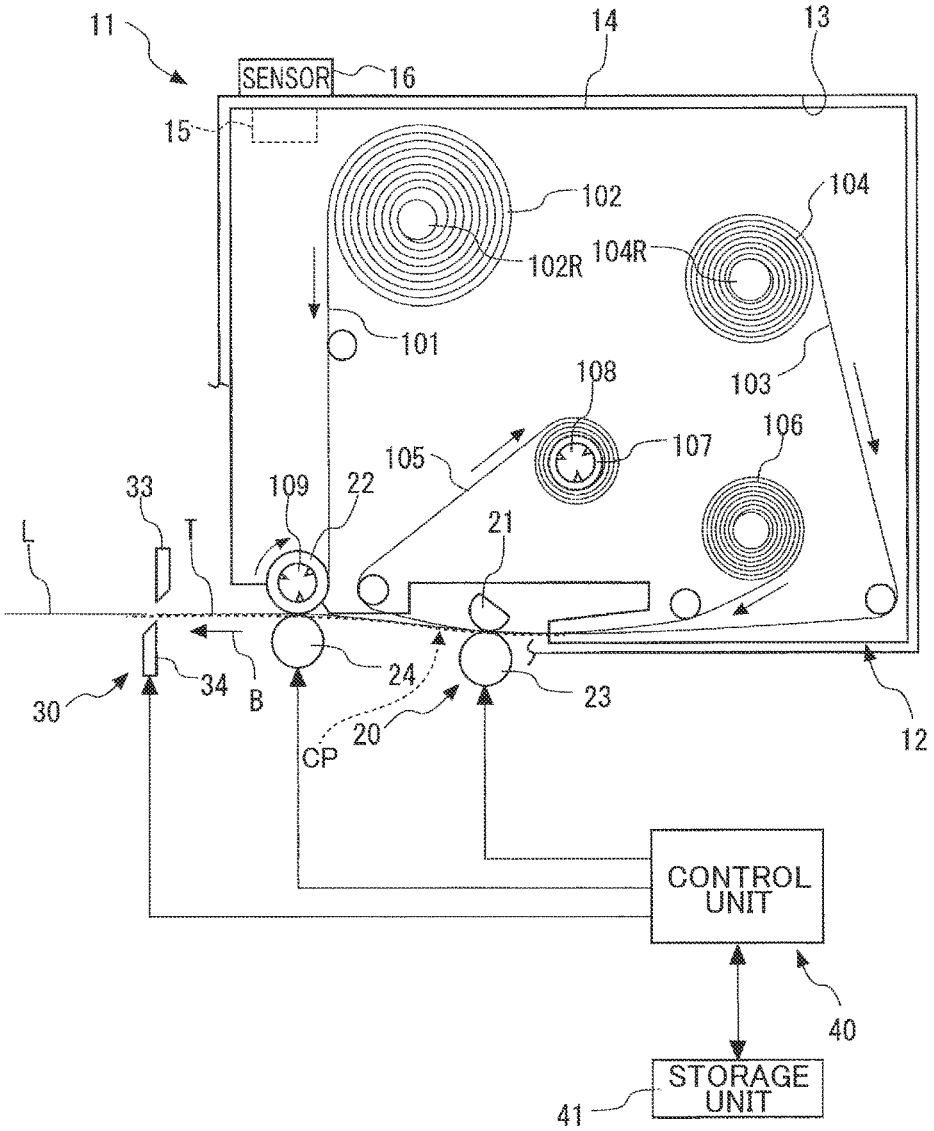
FIG. 1 is an explanatory view schematically illustrating the internal structure of a printed matter creating device according to one embodiment in the present embodiment.

FIG. 1 provides an overview of a printed matter creating device 11 in the present embodiment. The printed matter creating device 11 is provided with a cartridge holder 13 for accommodating a cartridge 12, a printing unit 20 having a printing head 21 (a thermal head, for example), a cutting unit 30, a control unit 40, and a storage unit 41 that is anon-transitory computer-readable storage medium. The cutting unit 30 is an example of the "cutter." The control unit 40 is an example of the "controller."

The printing head 21 is provided with a plurality of heating elements. The printing head 21 is configured to print on a printing medium T being conveyed. The printing head 21 is mounted on a head mounting unit (not shown) arranged upright in the cartridge holder 13.

The cartridge 12 has a tape discharge section (not shown). In a printing operation, the printing medium T is discharged first through the tape discharge section, and subsequently is discharged through a tape outlet formed in the printed matter creating device 11. The cartridge holder 13 accommodates the cartridge 12 such that the widthwise direction of the printing medium T being discharged through the tape outlet coincides with the left-right direction (hereinafter, referred to also as "horizontal direction").

The cartridge 12 includes a case 14, a first roll 102, a second roll 104, a ribbon supply roll 106, a ribbon take-up roller 107, and a tape feed roller 22 configured to convey the printing medium T along a conveying path CP shown in FIG. 1. These rolls and rollers are disposed in the case 14. The first roll 102 is formed of a strip-like base tape 101 wound into a roll. The second roll 104 is formed of a transparent cover film 103 wound into a roll. The cover film 103 has the same approximate width as the base tape 101. The ribbon supply roll 106 pays out an ink ribbon 105. The ribbon take-up roller 107 takes up the ink ribbon 105 that has been used for printing. The tape feed roller 22 is rotatably supported near the tape discharge section of the cartridge 12. The tape feed roller 22 is an example of the "conveyor."

Note that the cover film 103 having the base tape 101 bonded thereto constitutes the medium to be cut. That is, the medium to be cut is formed by bonding the base tape 101 to the cover film 103. Further, the wound state of each type of tape is depicted as a simplified spiral in FIG. 1. Additionally, while a thermal transfer ribbon or the like is used as the ink ribbon 105 in this specification, the ink ribbon 105 is unnecessary when the print tape is a thermal tape.

The first roll 102 includes a reel member 102R around which the base tape 101 is wound. Although the details of the base tape 101 are not depicted in the drawings, the base tape 101 has a four-layer structure, for example.

Beginning from the inside of the base tape 101 in its wound state and progressing toward the opposite side, the base tape 101 in this example is configured of the following layers laminated in the following order: an adhesive layer formed of an appropriate adhesive, a colored base film (base layer) formed of polyethylene terephthalate (PET) or the like, an adhesive layer (a mounting adhesive layer) formed of an appropriate adhesive, and a release paper (a release layer).

The second roll 104 similarly includes a reel member 104R around which the cover film 103 is wound.

The case 14 has a detectable part 15. A cartridge sensor 16 is provided in the cartridge holder 13 at a position corresponding to the detectable part 15 of the case 14.

The cartridge sensor 16 not only detects the mounted state of a cartridge 12, but also detects cartridge information related to the type of cartridge 12, i.e., cartridge information related to attributes of the object to be cut (the printing medium T and a label L). Here, attributes of an object to be cut means attributes required for a cutting process described later and denotes the type of cartridge 12.

A roller holder (not shown) is pivotably supported on a support shaft in the cartridge holder 13. A switching mechanism can switch the roller holder between a printing position (contact position) and a release position (separated position). A platen roller 23 and a tape-pressing roller 24 are rotatably arranged on this roller holder. When the roller holder is switched to the printing position, the platen roller 23 and tape-pressing roller 24 are pressed against the printing head 21 and tape feed roller 22, respectively. The base tape 101 and cover film 103 are pinched between the tape-pressing roller 24 and tape feed roller 22 and bonded together to form a printing medium T, while the tape feed roller 22 feeds the printing medium T in the direction indicated by an arrow B in FIG. 1.

A ribbon take-up roller drive shaft 108 and a tape feed roller drive shaft 109 are provided in the cartridge holder 13. The ribbon take-up roller 107 and tape feed roller 22 are driven to rotate in association with each other by the driving of the ribbon take-up roller drive shaft 108 and tape feed roller drive shaft 109.

Through this operation, a feeding drive force is applied to the printing medium T and the ink ribbon 105. The ribbon take-up roller drive shaft 108 and tape feed roller drive shaft 109 are driven by the drive force of a feeding motor (not shown) transmitted via a gear mechanism (not shown). The feeding motor is a pulse motor, for example, provided outside of the cartridge 12.

The cutting unit 30 is disposed on the conveying path CP and positioned downstream of the printing head 21 in the conveying direction (i.e., in the forward direction along the conveying path CP). The cutting unit 30 is separated from the printing head 21 by a prescribed distance along the conveying path CP. The cutting unit 30 has a function for making a full cut through the printing medium T. The cutting unit 30 is provided with a fixed blade 33, and a movable blade 34. The drive force of a cutter motor (not shown) is transmitted to the movable blade 34 via a drive transmission mechanism and the like, whereby the movable blade 34 performs a full cut in cooperation with the fixed blade 33. That is, the movable blade 34 cuts through all layers of the printing medium T (the cover film 103, adhesive layer, base film, adhesive layer, and release paper described above) in the thickness direction to create a label L.

When the cartridge 12 is mounted in the cartridge holder 13 with the internal units configured as described above, the cover film 103 and ink ribbon 105 are pinched between the printing head 21 and platen roller 23, and the base tape 101 and cover film 103 are pinched between the tape feed roller 22 and tape-pressing roller 24.

Next, the drive force of the feeding motor (not shown) drives the ribbon take-up roller 107 and tape feed roller 22 to rotate in synchronization in their take-up directions. Here, the tape feed roller drive shaft 109 is coupled to the tape-pressing roller 24 and platen roller 23 through gear mechanisms (not shown). Accordingly, the tape feed roller 22, tape-pressing roller 24, and platen roller 23 rotate together with the drive of the tape feed roller drive shaft 109, drawing the base tape 101 off the first roll 102 and supplying the base tape 101 to the tape feed roller 22.

At the same time, the cover film 103 is drawn off the second roll 104. The ink ribbon 105 driven by the ribbon supply roll 106 and ribbon take-up roller 107 is placed into contact with the back surface of the cover film 103 as the platen roller 23 presses the ink ribbon 105 and cover film 103 against the printing head 21. At this time, a plurality of heating elements (corresponding to dots) in the printing head 21 is energized to print a desired image on the back surface of the cover film 103 based on print data as the cover film 103 is conveyed in the conveying direction.

Next, the base tape 101 is integrally bonded to the just-printed cover film 103 between the tape feed roller 22 and tape-pressing roller 24 to form a printing medium T, and the printing medium T is conveyed out of the cartridge 12 via the tape discharge section. Through the drive of the ribbon take-up roller drive shaft 108, the ink ribbon 105 just used for printing the cover film 103 is taken up on the ribbon take-up roller 107.

Next, the cutting unit 30 performs a full cut on the printing medium T created by bonding the base tape 101 and cover film 103 together as described above, creating a label L. This label L is subsequently discharged from the printed matter creating device 11 through the tape outlet (not shown).

During these operations, the control unit 40 controls the driving (including resumption of driving after a temporary halt) and the halting (including a temporary halt) of the printing unit 20, feeding motor (represented by the tape-pressing roller 24 in FIG. 1), and cutting unit 30.

Upon acquiring print data, the control unit 40 stores this print data in RAM or ROM of the storage unit 41. In the present embodiment, the control unit 40 acquires print data by either generating the print data itself or receiving the print data from an external device. Note that a printed matter creating program is stored in the storage unit 41 and is executed by the control unit 40 for implementing processes described later (including the processes shown in FIGS. 6 and 7). The printed matter creating program is an example of the "computer-readable instructions." The storage unit 41 is an example of the "non-transitory computer-readable storage medium."

With this basic configuration, the printed matter creating device 11 according to the present embodiment adjusts aspects (attributes) of at least one of first ON dots and second ON dots in a data range (print data) corresponding to a connecting part based on the content of acquired print data. In other words, on the basis of the content of acquired print data, the printed matter creating device 11 according to the present embodiment adjusts aspects (attributes) of first ON dots in a data range (print data) corresponding to a connecting part, or adjusts aspects (attributes) of second ON dots in the data range (print data) corresponding to the connecting part, or adjusts aspects (attributes) of both the first ON dots and second ON dots in the data range (print data) corresponding to the connecting part. Through these adjustments, the printed matter creating device 11 according to the present embodiment corrects the level of darkness in an overlapped printing area (hereinafter also called a "junction") based on the print data in order to achieve satisfactory printing results without the overlapped printing area becoming noticeably darker.

Specifically, when a cutting process is executed on a conventional label printer to cut off the downstream end of a tape during the label creating process (during printing), the load generated in the cutting process may pull the tape on the upstream side of the cutting unit 30. This phenomenon tends to produce a white line void of printing at a printing position PT upstream of a cutting position CT, as illustrated in the top example of FIG. 2A.

Hence, a possible countermeasure for suppressing the occurrence of such white lines is to perform a junction print. In a junction print, overlapping dots are printed before and after the cutting process, as illustrated in the bottom example of FIG. 2A. However, when printing a design label having a photo, pattern, or the like rather than simple text, the printed content of the print data (the printing results) may introduce a noticeable vertical line along the overlapped print that detracts from the appearance. Such a deterioration in appearance is an issue which users cannot intuitively resolve.

Figure 2A:
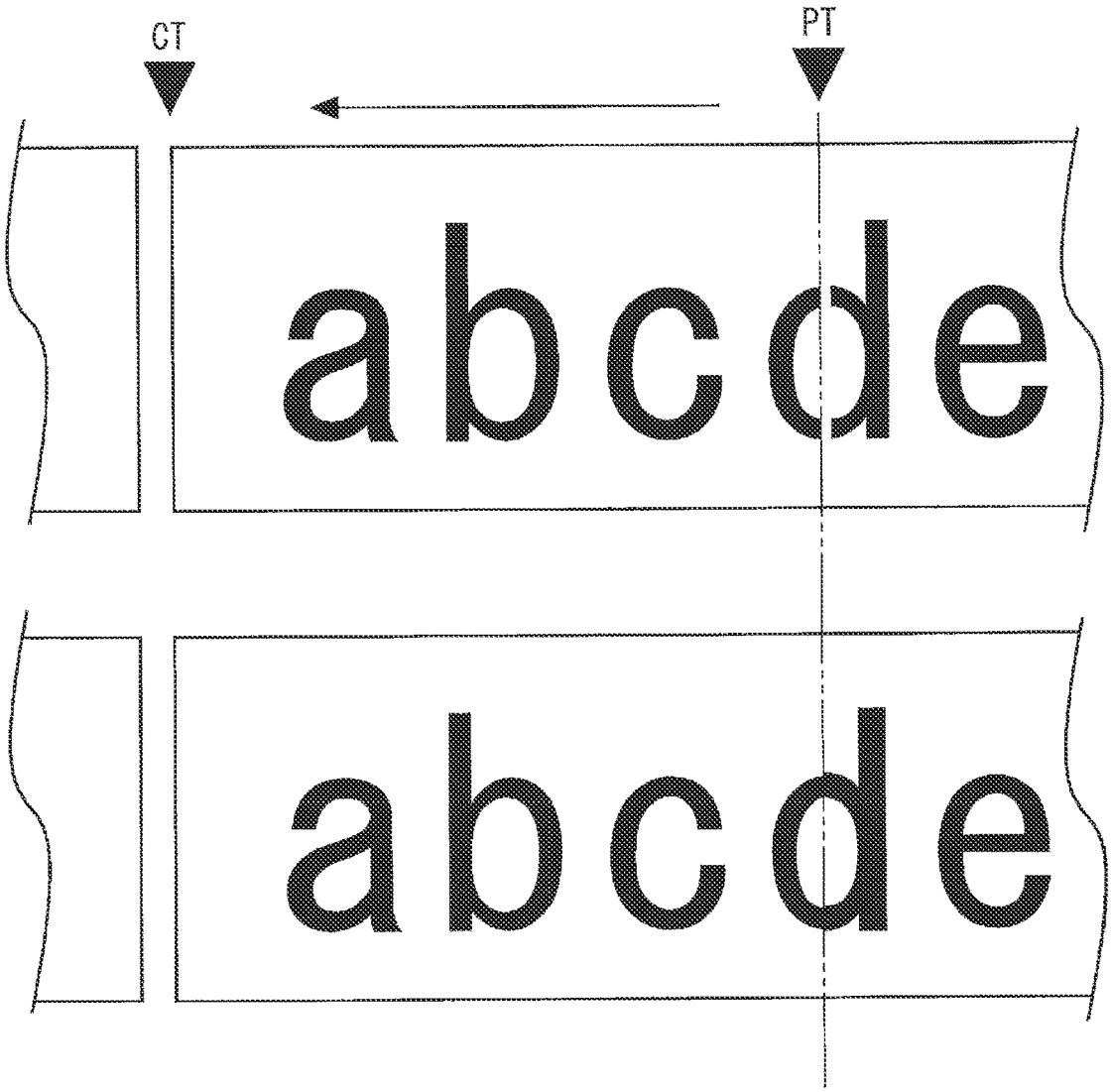
FIGS. 2A and 2B are views illustrating the positional relationship between a cutting position and a printing position, FIG. 2A being an explanatory view for an example of printing results on a main part of a printing medium, FIG. 2B being an explanatory view for adjustment results at a junction position between a first print and a second print.
Figure 2B:
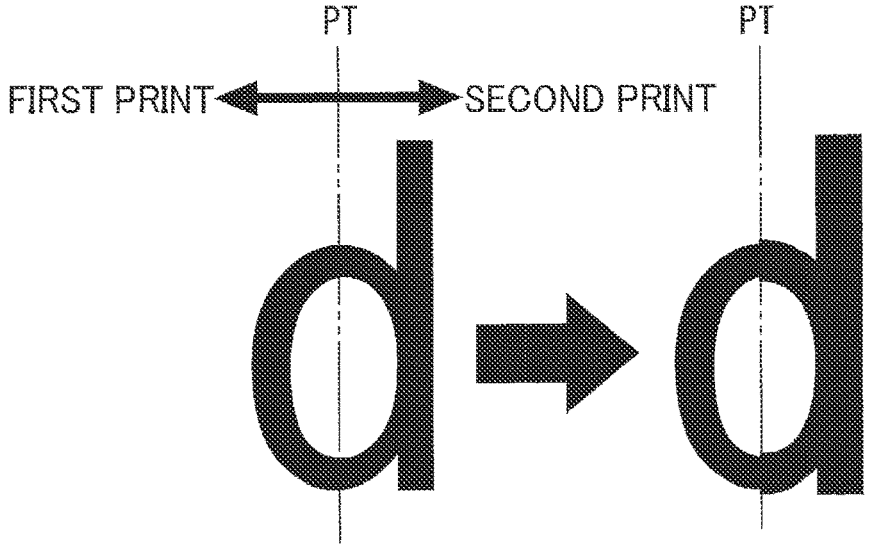

Therefore, when performing a cutting process on a tape undergoing printing, the control unit 40 in the present embodiment divides the print data centered on the printing position PT (the junction position), which is upstream of the cutting position CT, into first ON dots (the "first print" in FIG. 2) and second ON dots (the "second print" in FIG. 2), as illustrated in the left side of FIG. 2B. The control unit 40 then automatically adjusts printing conditions on the second ON dot side of this junction position, as illustrated in the enlarged view on the right side of FIG. 2B.

The occurrence of a white line can be suppressed if the control unit 40 can automatically adjust the width of the overlapped dots (i.e., the entire dimension in the conveying direction of the overlapped two dots) in a junction print based on the printing pattern that corresponds to this junction position. The printed matter creating device 11 may also be provided with a mode for prioritizing design quality (a second mode described later). When the printed matter creating device 11 is set to this mode, the cutting unit 30 does not automatically cut the tape. Rather, marks are added to the tape to facilitate the user in a manual cut, thereby avoiding the formation of a junction and achieving a high-quality print regardless of the design (the content) printed on the label L. This process can improve user-friendliness by adjusting junctions according to the user's priority.

As an example of automatically adjusting the width of overlapped dots in a junction print, the overlap rate (degree of overlapping dots) when overlapping dots (when performing a junction print) may be adjusted. Note that, alternatively to the above-described junction print, any junction print may be available. For example, the following junction print may be employed. In this junction print, print data is divided into first print data for the printing content of the downstream side of the printing position PT and second print data for the printing content of the upstream side of the printing position PT. Then, the last line data in the first print data is copied and added to the second print data as the leading line data of the second print data, so that the last line data of the first print data is identical to the leading line data of the second print data. Here, line data denotes print data corresponding to one dot row (dot array) along the main scanning direction. Thereafter, all the ON dots in the first print data for the first print are printed, and then the cutting process is performed to cut the cutting position CT. After the completion of the cutting process, all the ON dots for the second print data for the second print are printed such that the ON dots in the leading line data of the second print data are overlapped with the already printed ON dots in the last line data of the first print data.

Figure 3A:
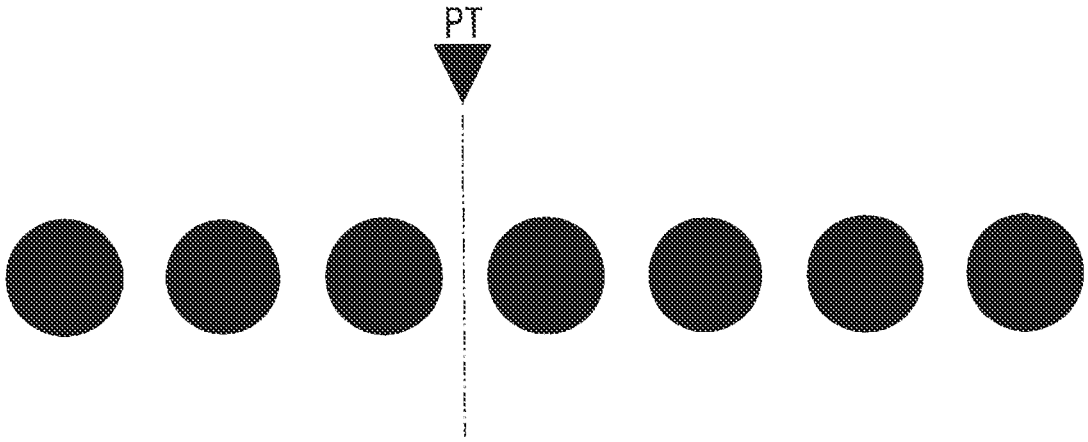
FIGS. 3A and 3B are views for explaining an example of adjustments for the degree of proximity when bringing dots closer to each other.
Figure 3B:
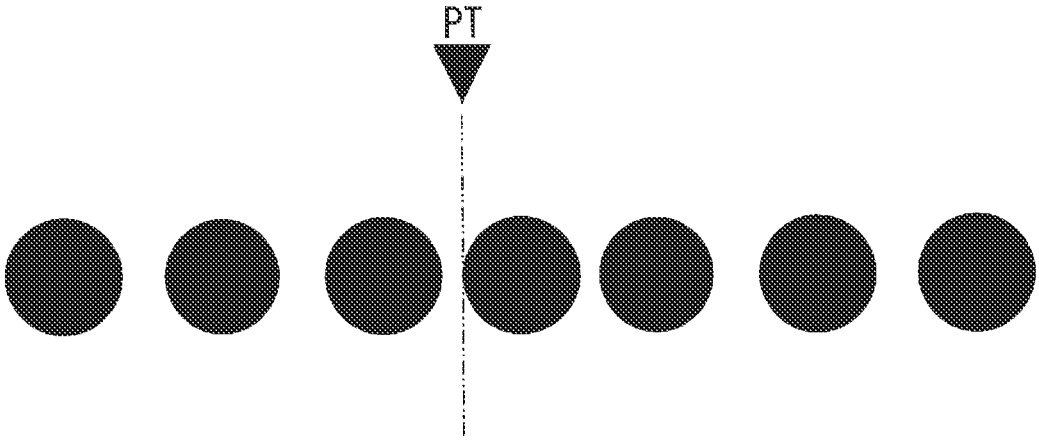

To suppress the occurrence of a white line, as shown in FIG. 3B, dots on the upstream side of the printing position PT (i.e., the portion to be printed after a cutting process is completed and printing is resumed) may be brought closer together to reduce the dot spacing for a prescribed dot range (two dots worth of, for example), in comparison to the dot spacing on the downstream side of the printing position PT or an example shown in FIG. 3A in which no control is executed for the dot spacing. Note that the concept of the above dot spacing includes a space between the last dot row on the downstream side of the printing position PT and the leasing dot row on the upstream side of the printing position. Alternatively, to suppress the occurrence of a white line, a space between the last dot row on the downstream side of the printing position PT and the leading dot row on the upstream side of the printing position PT may be reduced by bringing the ON dots in the leading dot row on the upstream side of the printing position PT closer to the ON dots in the last dot row on the downstream side of the printing position PT. Further, when such processes are performed, the proximity rate (the degree of bringing dots closer together) may be adjusted to suppress the above-described deterioration in appearance of a printed matter.

Figure 4:
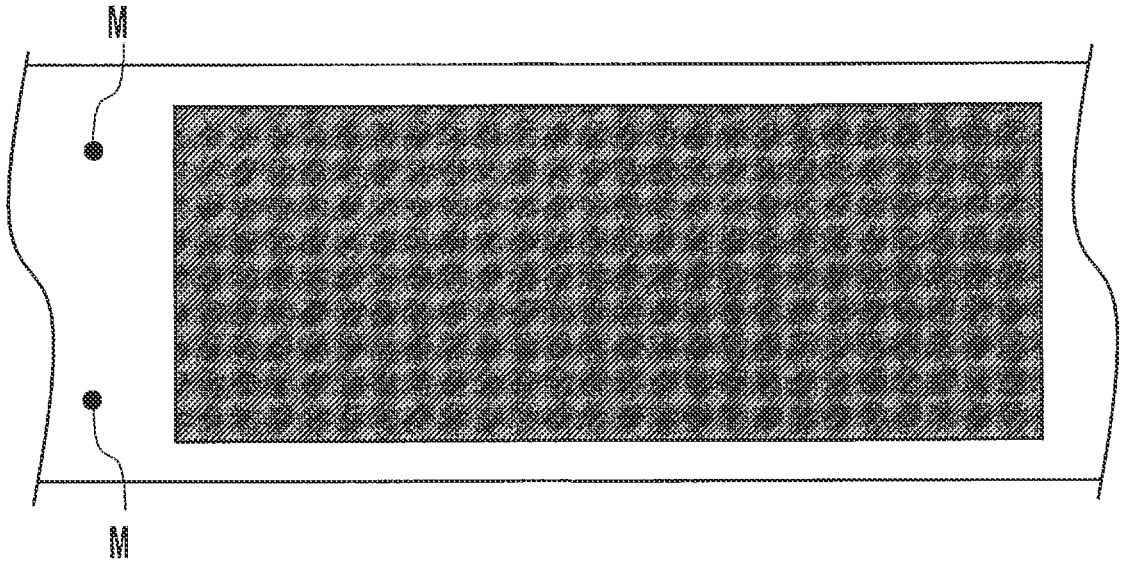
FIG. 4 is a perspective view of a printer.

Here, the proximity rate may be adjusted such that the arrangement of first ON dots and second ON dots in the print data is denser (closer together) when the first print and second print represent text characters, as in the example of FIG. 2A, than when the first print and second print represent a pattern or image (see FIG. 4).

An example for avoiding the occurrence of a junction when printing a design pattern or the like is to add marks for facilitating a manual cut rather than performing an automatic cut. As shown in FIG. 4, two marks M configured of black circles are printed at positions spaced apart from each other in the tape width direction. The marks M may be configured of lines or other shapes and are not limited to black circles.

Here, the control unit 40 can determine whether the print data represents characters or a pattern or image (hereinafter sometimes simply called an "image, etc."). For example, the presence or absence of a print dot (an ON dot), and specifically the presence or absence of a dot in a binarized state ignoring gradation, may differ between the first print side and second print side over the entire tape width that includes the printing position PT.

FIGS. 5A-5D illustrate examples of numbers of dots per unit area. In these examples, an evaluation value may be calculated by weighting each dot unit based not only whether a print is present but also whether the dot unit is among a continuous array of dots being printed in the conveying direction orthogonal to the main scanning direction. The degree of overlap/proximity may be set increasingly different for higher cumulative evaluation values.

The examples in FIGS. 5A-5D employ a 5×5 dot array centered on the printing position PT in the conveying direction as the evaluation unit. Here, the entire dimension of the tape width in the main scanning direction may be targeted. In the example shown in FIG. 5A, all dots 1-5 in row A and dot 1 in each of rows B, C, D, and E are OFF dots and, hence, are assigned the value "0". Dots 2-5 in each of rows B, C, and D are ON dots that continue on to the ON dots in the next row (the row to be next printed) in the conveying direction and, hence, are assigned the value "2". In other words, each of dots 2-5 in each of rows B, C, and D is an ON dot that forms a continuous ON dot array extending along the conveying direction, in cooperation with the neighboring dot in the next row. Thus, each of dots 2-5 in each of rows B, C, and D is assigned the value "2". Each of dots 2-5 in row E is an ON dot that does not form a continuous ON dot array extending in the conveying direction and, hence, is assigned the value "1". Adding all of these values brings the cumulative evaluation value to "28".

Figure 5A:
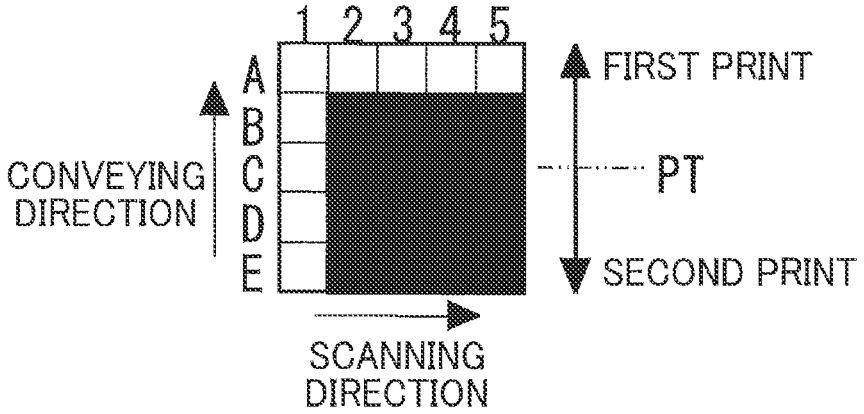
FIGS. 5A-5D are views for explaining a cumulative evaluation value calculated by a control unit.
Figure 5B:
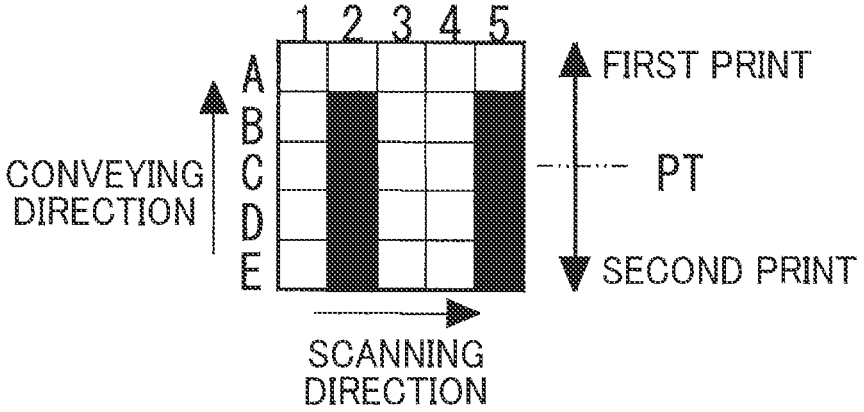

Similarly, in the example of FIG. 5B, each of dots 2 and 5 in each of rows B, C, and D is an ON dot that forms a continuous ON dot array in cooperation with the neighboring dot in the following row in the conveying direction and, hence, is assigned the value "2", while each of dots 2 and 5 in row E is an ON dot that does not form a continuous ON dot array in cooperation with the dot in the next row in the conveying direction and, hence, are assigned the value "1". Adding all of these values brings the cumulative evaluation value to "14".

Figure 5C:
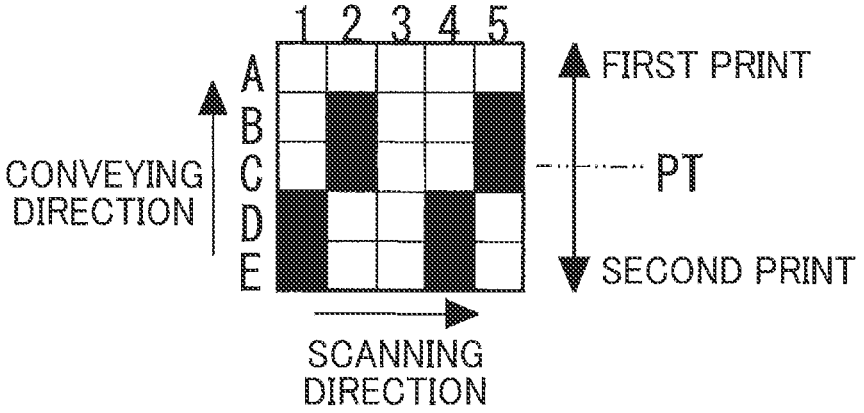

Moreover, evaluation units having the same number of ON dots may have different cumulative evaluation values. In the example of FIG. 5C, each of dots 2 and 5 in row B and dots 1 and 4 in row D is an ON dot that forms a continuous ON dot array in cooperation with the neighboring dot in the next row in the conveying direction and, hence, is assigned the value "2", while each dots 2 and 5 in row C and dots 1 and 4 in row E is an ON dot that does not form a continuous ON dot array in cooperation with the neighboring dot in the next row in the conveying direction and, hence, is assigned the value "1". Adding all of these values brings the cumulative evaluation value to "12".

Figure 5D:
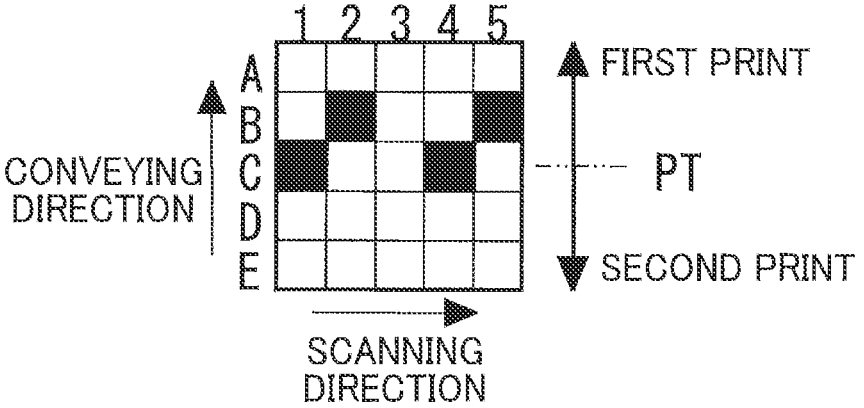

In the example of FIG. 5D, each of dots 2 and 5 in row B and dots 1 and 4 in row C is an ON dot that does not form a continuous ON dot array in cooperation with the neighboring dot in the next row in the conveying direction and, hence, is assigned the value "1". Adding all of these values bring the cumulative evaluation value to "4".

Therefore, based on a cumulative evaluation value, the control unit 40 can adjust aspects (attributes) of at least one of first ON dots and second ON dots through overlapping dots, bringing dots closer to each other, and the like, as described above. The cumulative evaluation value is calculated by taking the sum of evaluation values for all dots aligned in the conveying direction in print data corresponding to the connecting part (the junction position) and accumulating these sums in the main scanning direction.

Next, a specific example of control performed by this control unit 40 will be described. To begin with, a basic routine performed by the control unit 40 will be described with reference to FIG. 6.

In step S1, the control unit 40 executes an acquisition process (the acquisition procedure). In this process, the control unit 40 acquires print data created through direct input on the printed matter creating device 11 or print data created using a personal computer or the like, for example, and stores the acquired print data in the storage unit 41. Subsequently, the control unit 40 advances to step S2.

In step S2, the control unit 40 executes a data division process. In this process, the control unit 40 identifies format data for the printing medium T, such as the margins, character size (font size), and printing length based on the print data stored in the storage unit 41, and the distance from the cutting position CT to the printing position PT upstream of the cutting position CT on the printing medium T based on the distance separating the printing unit 20 from the cutting unit 30 in the conveying direction (i.e., along the conveying path CP). In other words, the control unit 40 identifies the cutting position CT and printing position PT on the printing medium T. Next, the control unit 40 divides the stored print data by setting the downstream side of the printing position PT to a first print and the upstream side of the printing position PT to a second print. In other words, in step S2 the control unit 40 divides the print data stored in the storage unit 41 into print data representing the first print (i.e., representing the printing content for the downstream side of the printing position PT) and print data representing the second print (i.e., representing the printing content for the upstream side of the printing position PT). Subsequently, the control unit 40 advances to step S3.

In step S3 the control unit 40 executes an ON dot adjustment process. In this process, the control unit 40 adjusts aspects (attributes) of at least one of the first ON dots and second ON dots in print data corresponding to a connecting part connecting the first print formed in a first printing process and the second print formed in a second printing process based on the acquired print data (the print data stored in the storage unit 41).

When second ON dots are the target of adjustments in the ON dot adjustment process of step S3, the control unit 40 performs at least one of: an adjustment on print data for the second print; an adjustment of dots formed by the printing unit 20; an adjustment of feeding distance by the tape feed roller 22; and an adjustment of feeding speed by the tape feed roller 22. The tape feed roller 22 is an example of the feeding unit. The following description of the ON dot adjustment process in step S3 will assume that second ON dots are the subject of adjustments.

Note that first ON dots may be the subject of adjustments in the ON dot adjustment process of step S3. In this case, the control unit 40 performs at least one of: an adjustment of print data in the first print; an adjustment of dots formed by the printing unit 20; and an adjustment of the feeding distance by the tape feed roller 22; and the feeding speed by the tape feed roller 22.

As will be described later in detail, after executing the process to divide print data stored in the storage unit 41 in step S2, the control unit 40 may determine (or the user may specify) whether to perform adjustments. Further, when determining to perform adjustments, the control unit 40 may determine (or the user may specify) which of the first print and second print is to be subjected to adjustments. Based on these determinations, the control unit 40 may then determine whether to execute a printing process in which prescribed conditions are set to normal printing conditions with no adjustments or to execute a printing process in which the prescribed conditions are set to adjusted printing conditions.

In step S4, the control unit 40 executes a first printing process (the first printing procedure). In the first printing process, the control unit 40 controls the tape feed roller 22 to convey the printing medium T while controlling the printing unit 20 to form the first print based on first ON dots included in the acquired print data. Subsequently, the control unit 40 advances to step S5.

In step S5, the control unit 40 executes a cutting process (the cutting procedure). Specifically, once the cutting position CT on the printing medium T arrives at the cutting unit 30 while the control unit 40 is conveying and printing on the printing medium T, the control unit 40 interrupts the conveyance of the printing medium T by the tape feed roller 22 while simultaneously terminating formation of the first print by the printing unit 20. This interruption of the conveyance is an example of the "interrupting process." Next, the control unit 40 controls the cutting unit 30 to cut the printing medium T. Subsequently, the control unit 40 advances to step S6.

Hence, the routine in step S5 includes a determination process in which the control unit 40 determines whether the cutting position CT of the printing medium T has been conveyed to the cutting unit 30. The control unit 40 continues printing and feeding the printing medium T until the cutting position CT has been conveyed to the cutting unit 30.

In step S6 the control unit 40 executes a second printing process (the second printing procedure). In the second printing process, the control unit 40 controls the tape feed roller 22 to feed the printing medium T while controlling the printing unit 20 to form the second print based on the second ON dots that have been adjusted in the ON dot adjustment process of step S3, thereby creating a printed matter (a label L). Subsequently, the control unit 40 ends the process in FIG. 6.

Figure 6:
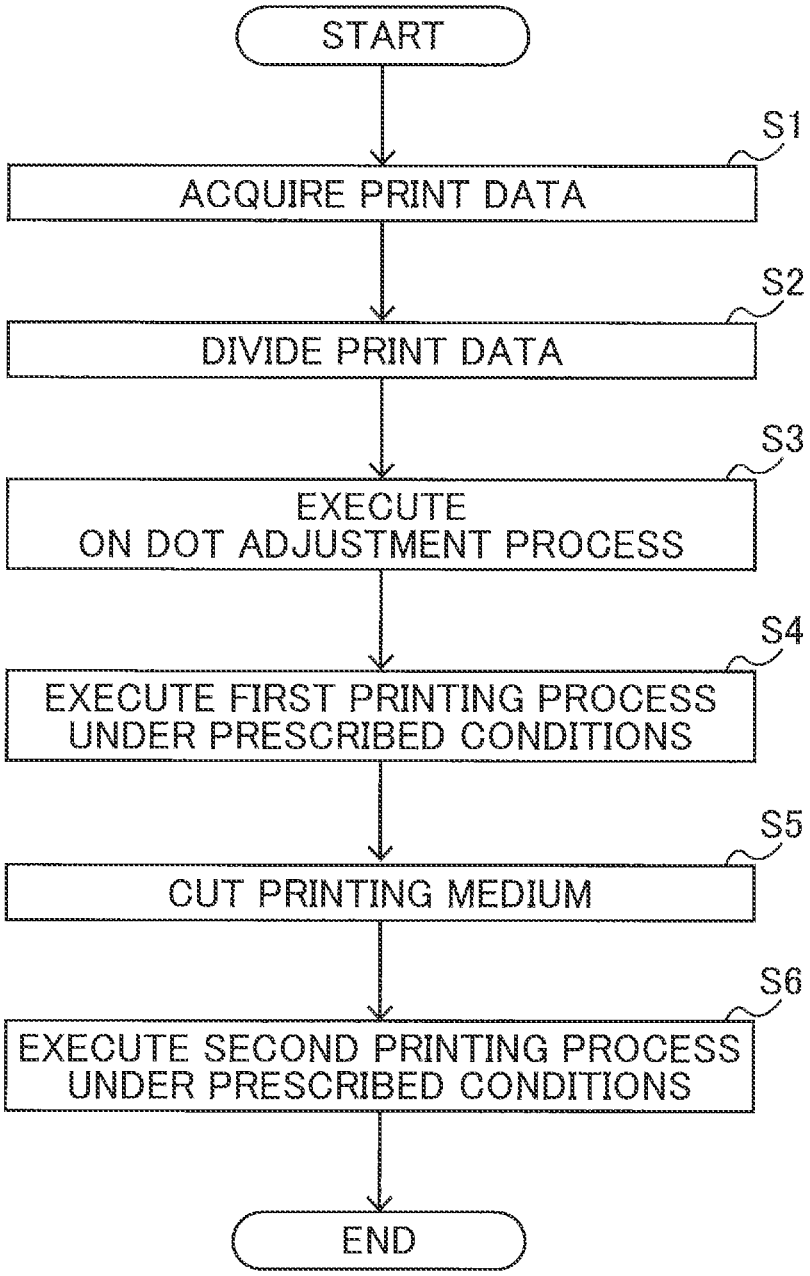
FIG. 6 is a flowchart of a main routine performed by the control unit.

As described above, the ON dot adjustment process may adjust aspects of at least one of the first ON dots and second ON dots. Accordingly, the descriptions of steps S4 and S6 in FIG. 6 are "Execute the first printing process under the prescribed conditions" and "Execute the second printing process under the prescribed conditions," respectively.

Further, in a case where printing of marks M is executed without executing the cutting process described above, the control unit 40 does not perform the cutting process in step S5, and performs a process to print marks M prior to performing the first print in step S3.

Next, a routine executed by the control unit 40 when using the cumulative evaluation value described above will be described with reference to FIG. 7.

In step S11, the control unit 40 executes an acquisition process (the acquisition procedure). In the acquisition process, the control unit 40 acquires either print data created through direct input on the printed matter creating device 11 or print data created using a personal computer or the like, for example, and stores the acquired print data in the storage unit 41. Subsequently, the control unit 40 advances to step S12.

In step S12, the control unit 40 executes a data division process. In the data division process, the control unit 40 identifies format data for the printing medium T, such as the margins, character size (font size), and printing length, based on the print data stored in the storage unit 41, and the distance from the cutting position CT to the printing position PT upstream of the cutting position CT on the printing medium T based on the distance separating the printing unit 20 from the cutting unit 30 in the conveying direction. In other words, the control unit 40 identifies the cutting position CT and printing position PT on the printing medium T. Next, the control unit 40 divides the stored print data by setting the downstream side of the printing position PT to the first print and the upstream side of the printing position PT to the second print. Subsequently, the control unit 40 advances to step S13.

In step S13 the control unit 40 executes an ON dot adjustment process based on the acquired print data (the print data stored in the storage unit 41). In the ON dot adjustment process of S13, the control unit 40 calculates adjustment values for adjusting at least one of the first ON dots and second ON dots in the print data corresponding to the connecting part connecting the first print to be formed in a first printing process and the second print to be formed in a second printing process.

Here, the control unit 40 may use the adjustment value in order to adjust the proximity rate when bringing at least one of the second ON dots in the print data corresponding to the connecting part closer to the first ON dots on the basis of the acquired print data. The cumulative evaluation value of the evaluation values shown in FIGS. 5A-5D is used as the adjustment value in the present embodiment.

In step S14, the control unit 40 executes a first printing process (the first printing procedure). In the first printing process, the control unit 40 controls the tape feed roller 22 to feed the printing medium T while controlling the printing unit 20 to form the first print based on first ON dots included in the acquired print data. Subsequently, the control unit 40 advances to step S15.

In step S15, the control unit 40 determines whether the cutting position CT on the printing medium T has been conveyed to the cutting unit 30. If the control unit 40 determines that the cutting position CT on the printing medium T has been conveyed to the cutting unit 30 (S15: YES), the control unit 40 advances to step S16. However, if the control unit 40 determines that the cutting position CT has not been conveyed to the cutting unit 30 (S15: NO), the control unit 40 continues the process in step S14.

In step S16 the control unit 40 executes a cutting process (the cutting procedure) once the cutting position CT on the printing medium T has arrived at the cutting unit 30. In the cutting process, the control unit 40 interrupts feeding by the tape feed roller 22 while simultaneously halting formation of the first print by the printing unit 20 and controls the cutting unit 30 to cut the printing medium T at the cutting position CT. Subsequently, the control unit 40 advances to step S17.

In step S17 the control unit 40 performs a reverse feeding process to control the tape feed roller 22 to convey the printing medium T a predetermined distance in the reverse direction along the conveying path CP (i.e., in the opposite direction to the direction indicated by the arrow B in FIG. 1). For example, the predetermined distance is pre-set to a greater distance than an estimated distance by which the printing medium T is pulled in the forward direction along the conveying path CP (i.e., in the same direction as the direction indicated by the arrow B) due to execution of the cutting process. In this case, the estimated distance is calculated in advance through experiments and the like.

In step S18 the control unit 40 determines whether the cumulative evaluation value calculated in step S13 as the adjustment value is greater than a predetermined threshold value. If the control unit 40 determines that the cumulative evaluation value is greater than the threshold value (S18: YES), the control unit 40 advances to step S19. However, if the control unit 40 determines that the cumulative evaluation value is not greater than the threshold value (S18: NO), the control unit 40 advances to step S20.

Here, when the cumulative evaluation value is greater than the threshold value (for example, when the number of ON dots per unit area is large and the ON dots are continuous and dense in the conveying direction, as in the example of FIG. 5A), in step S19 the control unit 40 feeds the printing medium T a shorter feeding distance (hereinafter called X pulses of normal rotation) in in the conveying direction (the normal rotating direction of the motor), i.e., in the forward direction along the conveying path CP. Subsequently, the control unit 40 advances to step S21.

On the other hand, when the cumulative evaluation value is smaller than the threshold value (for example, when the number of ON dots per unit area is small and the ON dots are discontinuous and sparse in the conveying direction, as in the example of FIG. 5D, in step S20 the control unit 40 feeds the printing medium T a longer feeding distance (hereinafter called Y pulses of normal rotation) in the conveying direction (the normal rotating direction of the motor), i.e., in the forward direction along the conveying path CP. Subsequently, the control unit 40 advances to step S21.

Hence, when the ON dots are sparse, it is difficult to distinguish between a white line generated by a shift in the printing medium or a white line appearing due to no ON dots in the print data itself. Accordingly, the formation of a white line does not detract from the appearance, even when the feeding distance is not shortened.

Note that, in place of the reverse feeding process of step S17, the control unit 40 may also execute a reverse feeding process before or after the cutting process to convey the printing medium T a first distance in the reverse direction along the conveying path CP, which direction is the direction opposite the normal direction (the forward direction) along the conveying path CP. The control unit 40 may set the first distance variably in the ON dot adjustment process based on the acquired print data. By this setting of the first distance, the overlap rate or the proximity rate is adjusted. In this way, if the printing position PT at the time of execution of the cutting process is aligned with a blank area between two characters or a blank area in the middle of one character, for example, this process can suitably reduce the gap enlarged by the cutting load.

Further, the control unit 40 may execute a reverse feeding process following the first printing process and prior to the cutting process in order to feed the printing medium T a first distance in the reverse direction, and a forward feeding process following the cutting process and prior to the second printing process for feeding the printing medium T a second distance in the forward direction. By setting the first distance and second distance to different values (including "0") in the ON dot adjustment process based on the acquired print data, the control unit 40 can set suitable forward and reverse feeds based on the content of the print data (such as whether the data represents characters or an image, etc. or the density of the ON dots) and may vary these feeding distances. By these settings of the first and second distances, the overlap rate or the proximity rate is adjusted.

In step S21 the control unit 40 executes a second printing process (the second printing procedure). In the second printing process, the control unit 40 controls the tape feed roller 22 to feed the printing medium T while controlling the printing unit 20 to form the second print based on the second ON dots that have been adjusted in the ON dot adjustment process of step S3, thereby creating a printed matter (a label L). Subsequently, the control unit 40 ends the process in FIG. 7.

Naturally, the control unit 40 may perform different control in different situations, such as whether performing continuous printing for continuously printing the same or different labels L or performing sequential printing for cutting the printing medium after each print of the same or different label L, or whether the printing position PT is present for the cutting position CT in a single label.

In other words, when the control unit 40 is executing sequential printing or when the printing position PT is not present for the cutting position CT in a single label, a printing process will not be executed after cutting the printing medium T. Therefore, it is not necessary to perform the ON dot adjustment process described above.

Thus, based on the acquired print data, in the ON dot adjustment process the control unit 40 can adjust the overlap rate when overlapping at least one of the second ON dots on the first ON dots in the print data corresponding to the connecting part. Accordingly, the control unit 40 can perform suitable printing for text or characters printing, for example.

Based on the acquired print data, the control unit 40 can adjust the proximity rate in the ON dot adjustment process when bringing at least one of the second ON dots closer to the first ON dots in print data corresponding to the connecting part. Accordingly, the control unit 40 can set a printing mode for cases when printing text, etc. and cases when printing images, etc. to obtain optimal image quality.

Further, the control unit 40 can execute a reverse feeding process before or after the cutting process to convey the printing medium T a first distance in the reverse direction opposite the forward direction and can set the first distance variably in the ON dot adjustment process based on the acquired print data. In this way, the control unit 40 can perform adjustments according to the arrangements of dots in the printing target and the like, such as an arrangement where the printing position PT is aligned with OFF dots.

Further, the control unit 40 can execute a reverse feeding process following the first printing process and prior to the cutting process in order to feed the printing medium T the first distance in the reverse direction opposite the forward direction, and a forward feeding process following the cutting process and prior to the second printing process for feeding the printing medium T the second distance in the forward direction, and can set the first distance and second distance to different values in the ON dot adjustment process based on the acquired print data. In this way, the control unit 40 can perform adjustments according to the density of dots and the like.

In the ON dot adjustment process, the control unit 40 adjusts at least one of aspects of the first ON dots and aspects of the second ON dots according to the type of print represented by the print data that has been acquired in the acquisition process. Accordingly, the control unit 40 can perform adjustments according to the arrangement of dots and the like in the printing target with consideration for the quality of the characters or images, etc.

When the first print and second print represent characters in text, in the ON dot adjustment process the control unit 40 adjusts the arrangement of the first ON dots and second ON dots in the print data corresponding to the connecting part to be denser than when the first print and second print represent a pattern or image.

There is a low probability of the deterioration in appearance described above when forming text on the printing medium T, even when the above process for suppressing a white line between the ending position of the first print and the starting position of the second print in the connecting part is performed at a high rate (e.g., a high overlap rate or a high proximity rate). Conversely, there is a high probability of the deterioration in appearance described above when forming a pattern or image on the printing medium T if the process described above for suppressing a white line is performed at a high rate (e.g., a high overlap rate or a high proximity rate).

Therefore, when the first print and second print represent text, the control unit 40 performs adjustments in the ON dot adjustment process to make the arrangement of first and second ON dots denser in the range of data corresponding to the connecting part than when the first print and second print represent a pattern or image. Accordingly, both a decline in aesthetic appearance and the occurrence of white lines can be reliably suppressed.

The printing unit 20 is a thermal head having a plurality of heating elements arranged along the main scanning direction. In the ON dot adjustment process, the control unit 40 adjusts aspects of at least one of the first ON dots and second ON dots based on the cumulative evaluation value. The cumulative evaluation value is calculated by taking the sum of evaluation values for dots aligned in the conveying direction within print data corresponding to the connecting part and accumulating those sums along the main scanning direction.

Accordingly, the control unit 40 can perform detailed and high-precision adjustments based on the distribution of ON dots in the range of data corresponding to the connecting part.

Further, the printed matter creating device 11 (the control unit 40) may be provided with a first mode and a second mode. In this case, the printed matter creating device 11 (the control unit 40) is configured to switch between the first mode and the second mode. In the first mode, the control unit 40 executes the first printing process, the cutting process, the second printing process, and the ON dot adjustment process. In the second mode, the control unit 40 does not execute these processes (i.e., the first printing process, the cutting process, the second printing process, and the ON dot adjustment process) but rather executes a third printing process in which the control unit 40 controls the tape feed roller 22 to convey the printing medium T while controlling the printing unit 20 to form a third print based on all ON dots included in the acquired print data.

In other words, when the first mode has been selected, the control unit 40 can suppress both the decline in aesthetic appearance and the occurrence of white lines described above by performing the first printing process, cutting process, second printing process, and ON dot adjustment process described above. On the other hand, by selecting the second mode when it is desirable to ensure a higher aesthetic appearance, the control unit 40 performs the third printing process without performing the cutting process, thereby forming a third print corresponding to all ON dots in the print data. By skipping the cutting process in the second mode, the formation of a white line and the drop in aesthetic appearance described above can be suppressed. Thus, providing two selectable modes in this way further improves convenience for the user.

When the second mode is selected, the control unit 40 prints marks M in the third printing process for assisting the user in manually cutting the printing medium T. The marks M are printed on the expected cutting portion of the printing medium T. The expected cutting portion is a portion that is cut by the cutting unit 30 in the cutting process when the first mode is set. In other words, the expected cutting portion is a portion which the cutting unit 30 would cut in the cutting process if the first mode were set. The mark M is an example of the "cutting mark."

Since the printed matter creating device 11 does not perform the cutting process in the second mode, the user must cut the printing medium T using a suitable cutting tool. Thus, by having the control unit 40 in the present embodiment print marks M at the position to be cut, the user can easily cut the printing medium T at the appropriate position.

The control unit 40 also executes a determination process to determine whether at least one of the first and second ON dots is present in print data corresponding to the connecting part, i.e., whether neither first ON dots nor second ON dots are present in print data corresponding to the connecting part. In the event that the control unit 40 determines in the determination process that neither first ON dots nor second ON dots are present, during the second mode the control unit 40 makes the exception of executing the first printing process, cutting process, and second printing process. That is, even in a case where the second mode is set, when determining that neither first ON dots nor second ON dots are present in print data corresponding to the connecting part, the control unit 40 executes the first printing process, cutting process, and second printing process during the second mode.

In the second mode described above, the printed matter creating device 11 does not perform the cutting process in order to ensure a high-quality aesthetic appearance in the connecting part connecting the first print and second print. However, when neither first ON dots nor second ON dots are present in the range of data corresponding to this connecting part, any shifts in the printing medium or the like caused by an impact during cutting will not detract from the aesthetic appearance.

For this reason, the control unit 40 performs the determination process to determine whether at least one of the first and second ON dots is present in this data range. If neither are present, the control unit 40 makes the exception of executing the first printing process, cutting process, and second printing process. Hence, by eliminating the need for the user to perform a manual cut, this method improves convenience for the user.

Figure 7:
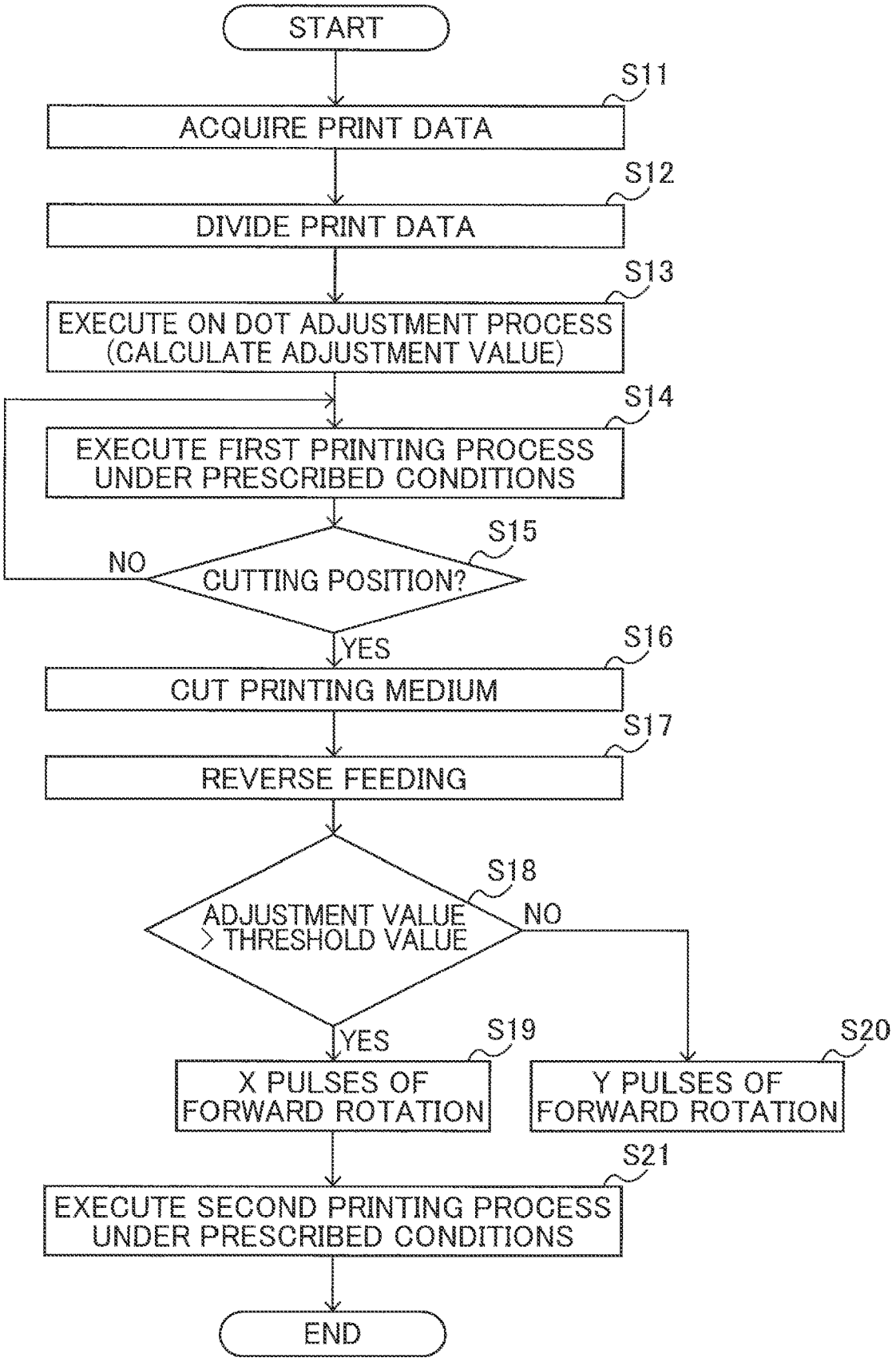
FIG. 7 is a flowchart of a routine performed by the control unit using the cumulative evaluation value.

As described above, the control unit 40 of the printed matter creating device 11 executes the control routine shown in FIG. 6 or 7. In other words, the printed matter creating program, when executed by the control unit 40, causes the printed matter creating device 11 to execute the control routine shown in FIG. 6 or 7.

That is, in the first printing process performed by the printed matter creating device 11, the control unit 40 controls the tape feed roller 22 to convey the printing medium T while controlling the printing unit 20 to form the first print on the printing medium T based on first ON dots included in the print data acquired in the data acquisition process. Subsequently, the cutting unit 30 is controlled to cut the printing medium T in the cutting process while conveyance has been interrupted and formation of the first print has been completed.

In the second printing process following the cutting process, the control unit 40 controls the tape feed roller 22 to convey the printing medium T while controlling the printing unit 20 to form the second print on the printing medium T based on second ON dots included in the print data that has been acquired during the data acquisition process.

In such a series of steps including (1) ending printing in a first printing process→(2) interrupting printing during a cutting process→(3) resuming printing in a second printing process, there is a concern that a shift in the printing medium or the like caused by an impact during cutting could produce a white line between the ending portion of the first print and the resuming portion of the second print. To avoid this occurrence, a prescribed process is performed in the present disclosure between first ON dots and second ON dots in the range of data corresponding to the connecting part connecting the first print formed in the first printing process and the second print formed in the second printing process.

Examples of the prescribed process includes: a process of overlapping at least one of the second ON dots over the first ON dots in the data range corresponding to the connecting part; and a process of bringing (moving) at least one of the second ON dots closer to the first ON dots in the data range corresponding to the connecting part. Here, if the printing engine (the printing head) in the printed matter creating device is an inkjet head rather than a thermal head, the prescribed process could be a process for adjusting the sizes of ink droplets corresponding to first ON dots or ink droplets corresponding to second ON dots within the data range corresponding to the connecting part. Through such processes, the occurrence of white lines can be suppressed.

However, depending on the content of the acquired print data, the above process performed to suppress white lines may result in the connecting part being printed noticeably darker than prints in other areas. In some cases, this may result in a condition that is not aesthetically pleasing.

Therefore, in the present embodiment, the printed matter creating device 11 performs the ON dot adjustment process to adjust, on the basis of the content of print data acquired in the data acquisition process, aspects of at least one of the first ON dots and second ON dots in the data range corresponding to the connecting part. For example, when an overlapping process is performed to overlap the first ON dots and second ON dots, this overlap rate is adjusted. Alternatively, when a proximity process is performed to bring first ON dots and second ON dots closer together, this proximity rate is adjusted. Further, when a reverse feeding process of a first distance and a forward feeding process of a second distance are respectively performed before and after the cutting process in order to execute the overlapping process or the proximity process described above, the magnitudes of these first and second distances are suitably adjusted. Further, when an inkjet head is used as the printing engine (the printing head), the sizes of ink droplets corresponding to first ON dots and ink droplets corresponding to second ON dots are adjusted.

Through such suitable adjustments, the present disclosure can suppress the occurrence of a white line in the connecting part while suppressing a deterioration in appearance owing to the print in the connecting part being more noticeable than prints in other areas.

Based on the acquired print data, the control unit 40 adjusts the overlap rate in the ON dot adjustment process when overlapping at least one of the second ON dots on the first ON dots in print data corresponding to the connecting part. Accordingly, the control unit 40 can suppress the occurrence of white lines while ensuring good appearance through simple control.

Based on the acquired print data, the control unit 40 can adjust the proximity rate in the ON dot adjustment process when bringing (moving) at least one of the second ON dots closer to the first ON dots in print data corresponding to the connecting part. In this way, the control unit 40 can adjust the proximity rate according to the density of dots in print data at the printing position PT for the cutting position CT.

The control unit 40 can also execute a reverse feeding process before or after the cutting process to convey the printing medium T the first distance in the reverse direction opposite the forward direction and can set the first distance variably in the ON dot adjustment process based on the acquired print data. Thus, when the printing position PT at the time of cutting the printing medium T is aligned with a blank area between two characters or a blank area in the middle of a character, for example, this process can suitably reduce a gap enlarged by the cutting load.

When the first print and second print represent text, in the ON dot adjustment process the control unit 40 adjusts the arrangement of first ON dots and second ON dots in the print data corresponding to the connecting part to a higher density than when the first print and second print represent a pattern or image.

There is a low probability of the deterioration in appearance described above when forming text on the printing medium T, even when the above process for suppressing a white line between the ending position of the first print and the starting position of the second print in the connecting part is performed at a high rate (at a high overlap rate or a high proximity rate). Conversely, there is a high probability of the deterioration in appearance described above when forming a pattern or image on the printing medium T if the process described above for suppressing a white line is performed at a high rate (at a high overlap rate or a high proximity rate).

Therefore, when the first print and second print are text, the control unit 40 performs adjustments in the ON dot adjustment process to make the arrangement of first and second ON dots denser in the range of data corresponding to the connecting part than when the first print and second print represent a pattern or image. Accordingly, the control unit 40 can reliably suppress both a decline in aesthetic appearance and the occurrence of white lines.

The printing unit 20 (the printing head 21) is a thermal head having a plurality of heating elements arranged along the main scanning direction. In the ON dot adjustment process, the control unit 40 adjusts aspects of at least one of the first ON dots and second ON dots based on a cumulative evaluation value. The cumulative evaluation value is found by taking the sum of evaluation values for dots aligned in the conveying direction within print data corresponding to the connecting part and accumulating those sums along the main scanning direction.

Accordingly, the control unit 40 can perform detailed and high-precision adjustments based on the distribution of ON dots in the range of data corresponding to the connecting part.

The control unit 40 is provided with a first mode and a second mode and can switch between the first mode and the second mode. In the first mode, the control unit 40 executes the first printing process, the cutting process, the second printing process, and the ON dot adjustment process. In the second mode, the control unit 40 does not execute these processes but rather executes a third printing process in which the tape feed roller 22 conveys the printing medium T while the printing unit 20 forms a third print based on all ON dots included in the acquired print data.

As described above, the control unit 40 is provided with two modes, namely, the first and second modes. Accordingly, when set to the first mode the control unit 40 can suppress both the decline in aesthetic appearance and the occurrence of white lines described above by performing the first printing process, cutting process, second printing process, and ON dot adjustment process described above. On the other hand, by selecting the second mode when it is desirable to ensure a higher aesthetic appearance, the control unit 40 performs the third printing process without performing the cutting process, thereby forming a third print corresponding to all ON dots in the print data. By skipping the cutting process in the second mode, the control unit 40 can avoid the formation of a white line and the drop in aesthetic appearance described above. Thus, providing two selectable modes in this way further improves convenience for the user.

When the second mode is selected, the control unit 40 prints marks M in the third printing process for assisting the user in manually cutting the printing medium T. The marks M are printed at the expected cutting portion of the printing medium which the cutting unit 30 would cut during the cutting process if the first mode were set.

Since the printed matter creating device 11 does not perform the cutting process in the second mode, the user must cut the printing medium T using a suitable cutting tool. Thus, by having the control unit 40 in the present embodiment print marks M at the position to be cut, the user can easily cut the printing medium T at the appropriate position.

The control unit 40 also executes a determination process to determine whether at least one of the first and second ON dots is present in print data corresponding to the connecting part, i.e., whether neither first ON dots nor second ON dots are present in print data corresponding to the connecting part. In the event that the control unit 40 determines in the determination process that neither first ON dots nor second ON dots are present, during the second mode the control unit 40 makes the exception of executing the first printing process, cutting process, and second printing process.

In the second mode described above, the printed matter creating device 11 does not perform the cutting process in order to ensure a high-quality aesthetic appearance in the connecting part connecting the first print and second print. However, when neither first ON dots nor second ON dots are present in the range of data corresponding to this connecting part, any shifts in the printing medium or the like caused by an impact during cutting do not detract from the aesthetic appearance.

For this reason, the control unit 40 performs the determination process to determine whether at least one of the first and second ON dots is present in this data range. If neither are present, the control unit 40 makes the exception of executing the first printing process, cutting process, and second printing process. Hence, by eliminating the need for the user to perform a manual cut, this method improves convenience for the user.

In the present embodiment, the storage unit 41 stores therein the printed matter creating program for the printed matter creating device 11 that is provided with the tape feed roller 22 for conveying the printing medium T along the conveying path CP; the printing unit 20 (the printing head 21) for printing on the printing medium T being conveyed in the forward direction along the conveying path PC by the tape feed roller 22; the cutting unit 30 disposed a prescribed distance downstream of the printing unit 20 along the conveying path PC for cutting the printing medium T; and the control unit 40. The printed matter creating program, when executed by the control unit 40, causes the printed matter creating device 11 to implement an acquisition procedure for acquiring print data; a first printing procedure for forming a first print with the printing unit 20 based on first ON dots included in the acquired print data while controlling the tape feed roller 22 to convey the printing medium T; a cutting procedure performed after the first printing procedure for controlling the cutting unit 30 to cut the printing medium T after interrupting conveyance by the tape feed roller 22 and halting formation of the first print by the printing unit 20; a second printing procedure performed after the cutting procedure for producing printed matter by controlling the printing unit 20 to form a second print based on second ON dots included in the acquired print data while controlling the tape feed roller 22 to convey the printing medium T; and an ON dot adjustment procedure for adjusting aspects of at least one of the first ON dots and the second ON dots in print data corresponding to a connecting part connecting the first print formed in the first printing procedure and the second print formed in the second printing procedure based on the acquired print data. This embodiment can obtain the same effects described above.

While the disclosure has been described in detail with reference to specific embodiments thereof, it would be apparent to those skilled in the art that many modifications and variations may be made therein. Below, some variations of the embodiment will be described.

(1) Inkjet Method

While the printing unit 20 (the printing head 21) is a thermal head in the embodiment described above, the printing unit 20 (the printing head 21) may be configured as an inkjet head, for example. In this case, the sizes of ink droplets corresponding to first ON dots and ink droplets corresponding to second ON dots may be adjusted as described above.

(2) Adjustments of First ON Dots

The present embodiment has described a case in which the printing position PT is a junction position and the control unit 40 adjusts the overlap rate (darker or lighter, for example) when overlapping ON dots on the upstream side (i.e., the second print side) of the printing position PT or adjusts the proximity rate (degree of proximity) when bringing ON dots closer together on the upstream side of the printing position PT. However, adjustments for the overlap rate or the proximity rate may be performed on the first print side (the downstream side) of the printing position PT instead.

(3) Print Tape

While the above embodiment describes a laminating method in which printing is performed on the cover film 103 separate from the base tape 101, and the cover film 103 and base tape 101 are subsequently bonded together. However, the present disclosure may be applied to a method of printing on a print tape layer provided in the base tape (a non-laminating type).

In addition, although not illustrated individually, the present disclosure may be implemented with various modifications.

What is claimed is:

1. A printed matter creating device comprising:

a conveyor configured to convey a printing medium along a conveying path;

a printing head configured to form a print on the printing medium being conveyed in a forward direction along the conveying path by the conveyor;

a cutter configured to cut the printing medium, the cutter being disposed on the conveying path, the cutter being positioned downstream of the printing head in the forward direction, the cutter being separated from the printing head a prescribed distance along the conveying path; and a controller configured to perform:

an acquisition process to acquire print data;

after completing the acquisition process, a first printing process to control the printing head to form a first print on the printing medium while controlling the conveyor to convey the printing medium, the first print being based on first ON dots included in the acquired print data;

after completing the formation of the first print in the first printing process, an interrupting process to interrupt the conveyance of the printing medium by the conveyor;

after performing the interrupting process, a cutting process to control the cutter to cut the printing medium; and after completing the cutting process, a second printing process to control the printing head to form a second print on the printing medium while controlling the conveyor to convey the printing medium, the second print being based on second ON dots included in the acquired print data, wherein the acquired print data includes specific print data corresponding to a connecting part connecting the first print and the second print, and wherein the controller further performs:

an ON dot adjustment process to perform adjusting, on the basis of the acquired print data:

aspects of specific first ON dots, the specific first ON dots being the first ON dots that are in the specific print data; or aspects of specific second ON dots, the specific second ON dots being the second ON dots that are in the specific print data; or both the aspects of the specific first ON dots and the aspects of the specific second ON dots.

2. The printed matter creating device according to claim 1, wherein the aspects of the specific second ON dots are adjusted in the ON dot adjustment process, and wherein, in the ON dot adjustment process, the controller adjusts, on the basis of the specific print data, an overlap rate when overlapping at least one of the specific second ON dots on the specific first ON dots.

3. The printed matter creating device according to claim 2, wherein the controller is configured to further perform:

after completing the cutting process or before starting the cutting process, a reverse feeding process to control the conveyor to convey the printing medium a first distance along the conveying path in a reverse direction opposite the forward direction, and wherein, in the ON dot adjustment process, the controller adjusts the overlap rate by setting the first distance on the basis of the specific print data.

4. The printed matter creating device according to claim 2, wherein the controller is configured to further perform:

after completing the first printing process and before starting the cutting process, a reverse feeding process to control the conveyor to convey the printing medium a first distance in a reverse direction opposite the forward direction; and after completing the cutting process and before starting the second printing process, a forward feeding process to control the conveyor to convey the printing medium a second distance in the forward direction, and wherein, in the ON dot adjustment process, the controller adjusts the overlap rate by setting the first distance and the second distance to different distances from each other on the basis of the specific print data.

5. The printed matter creating device according to claim 1, wherein the aspects of the specific second ON dots are adjusted in the ON dot adjustment process, and wherein, in the ON dot adjustment process, the controller adjusts, on the basis of the specific print data, a proximity rate when bringing at least one of the specific second ON dots closer to the specific first ON dots.

6. The printed matter creating device according to claim 5, wherein the controller is configured to further perform:

after completing the cutting process or before starting the cutting process, a reverse feeding process to control the conveyor to convey the printing medium a first distance along the conveying path in a reverse direction opposite the forward direction, and wherein, in the ON dot adjustment process, the controller adjusts the proximity rate by setting the first distance on the basis of the specific print data.

7. The printed matter creating device according to claim 5, wherein the controller is configured to further perform:

after completing the first printing process and before starting the cutting process, a reverse feeding process to control the conveyor to convey the printing medium a first distance in a reverse direction opposite the forward direction; and after completing the cutting process and before starting the second printing process, a forward feeding process to control the conveyor to convey the printing medium a second distance in the forward direction, and wherein, in the ON dot adjustment process, the controller adjusts the proximity rate by setting the first distance and the second distance to different distances from each other on the basis of the specific print data.

8. The printed matter creating device according to claim 1, wherein the adjusting in the ON dot adjustment process is performed on the basis of a type of a print represented by the print data acquired in the acquisition process.

9. The printed matter creating device according to claim 1, wherein, when the first print and the second print represent text characters, in the ON dot adjustment process the controller adjusts arrangement of the specific first ON dots and the specific second ON dots to be denser than when the first print and the second print represent a pattern or image.

10. The printed matter creating device according to claim 1, wherein the printing head is a thermal head having a plurality of heating elements arranged in a main scanning direction orthogonal to the forward direction, wherein the specific print data includes a plurality of dot arrays each being constituted by a plurality of dots aligned in the forward direction, the dot arrays being arranged in the main scanning direction, and wherein the adjusting in the ON dot adjustment process is performed on the basis of a cumulative evaluation value calculated by taking a sum of evaluation values for the dots in each of the dot arrays and accumulating the sums in the main scanning direction.

11. The printed matter creating device according to claim 1, wherein the controller is provided with a first mode and a second mode and is configured to switch between the first mode and the second mode, wherein, in the first mode, the controller performs the first printing process, the cutting process, the second printing process, and the ON dot adjustment process, and wherein, in the second mode, the controller performs neither the first printing process, the cutting process, the second printing process, nor the ON dot adjustment process but rather performs a third printing process to control the printing head to forms a third print based on all ON dots included in the acquired print data while controlling the conveyor to convey the printing medium.

12. The printed matter creating device according to claim 11, wherein, in the third printing process, the controller controls the printing head to print a cutting mark on a specific portion of the printing medium, the specific portion being a portion that is cut in the cutting process when the first mode is set.

13. The printed matter creating device according to claim 11, wherein the controller is configured to further perform:

a determination process to determine whether neither the specific first ON dots nor the specific second ON dots are present in the specific print data, and wherein, when determining in the determination process performed in the second mode that neither the specific first ON dots nor the specific second ON dots are present in the specific print data, the controller makes an exception of performing the first printing process, the cutting process, and the second printing process.

14. A non-transitory computer-readable storage medium storing a set of computer-readable instructions for a printed matter creating device, the printed matter creating device including: a controller; a conveyor configured to convey a printing medium along a conveying path; a printing head configured to form a print on the printing medium being conveyed in a forward direction along the conveying path by the conveyor; and a cutter configured to cut the printing medium, the cutter being disposed on the conveying path, the cutter being positioned downstream of the printing head in the forward direction, the cutter being separated from the printing head a prescribed distance along the conveying path, the set of computer-readable instructions, when executed by the controller, causing the printed matter creating device to perform:

an acquisition process to acquire print data;

after completing the acquisition process, a first printing process to control the printing head to form a first print on the printing medium while controlling the conveyor to convey the printing medium, the first print being based on first ON dots included in the acquired print data;

after completing the formation of the first print in the first printing process, an interrupting process to interrupt the conveyance of the printing medium by the conveyor;

after performing the interrupting process, a cutting process to control the cutter to cut the printing medium; and after completing the cutting process, a second printing process to control the printing head to form a second print on the printing medium while controlling the conveyor to convey the printing medium, the second print being based on second ON dots included in the acquired print data, wherein the acquired print data includes specific print data corresponding to a connecting part connecting the first print and the second print, and wherein the set of computer-readable instructions, when executed by the controller, causes the printed matter creating device to further perform:

an ON dot adjustment process to perform adjusting, on the basis of the acquired print data:

aspects of specific first ON dots, the specific first ON dots being the first ON dots that are in the specific print data; or aspects of specific second ON dots, the specific second ON dots being the second ON dots that are in the specific print data; or both the aspects of the specific first ON dots and the aspects of the specific second ON dots.

* * * * *